United States Patent [19]

McLarén et al.

[11] 4,105,202

[45] Aug. 8, 1978

[54] GAME APPARATUS

[76] Inventors: Keir McLarén, 628 Woodland Ave.; Daniel William Wagner, 419 Washington Ave., both of Oakmont, Pa. 15139

[21] Appl. No.: 774,336

[22] Filed: Mar. 4, 1977

[51] Int. Cl.[2] ..... A63F 1/00; A63F 1/10; A63F 9/00

[52] U.S. Cl. ..... 273/309; 35/9 R; 35/9 E; 35/69; 40/124.2; 273/296; 148/4

[58] Field of Search ..... 273/1 R, 1 E, 1 M, 93 C, 273/130 R, 130 A, 130 AB, 130 AC, 130 E, 134 C, 135 B, 136 R, 136 A, 136 B, 136 E, 136 G, 136 H, 136 K, 136 W, 136 Z, 148 R, 148 A, 152.43, 152.5; 35/9 R, 9 E, 69; 40/124.2

[56] References Cited

U.S. PATENT DOCUMENTS

| | | | |
|---|---|---|---|
| D. 44,430 | 7/1913 | Wilson | 273/152.43 X |
| 1,009,018 | 11/1911 | Braine | 273/130 R |
| 1,105,835 | 8/1914 | Radley | 273/148 A UX |
| 1,878,008 | 9/1932 | Snelling | 273/152.42 UX |
| 2,542,870 | 2/1951 | Hyland | 273/130 R |
| 2,717,156 | 9/1955 | Nelson | 273/148 A X |
| 2,742,290 | 4/1956 | Fasana | 273/93 C |
| 3,722,885 | 3/1973 | Leaf | 273/1 R |
| 3,814,435 | 6/1974 | Stratton | 273/135 B |
| 4,003,577 | 1/1977 | Bolach | 273/148 A X |
| 4,029,320 | 6/1977 | Hausman | 35/9 R X |

*Primary Examiner*—Paul E. Shapiro
*Attorney, Agent, or Firm*—Howard E. Sandler

[57] ABSTRACT

A game apparatus and more particularly a game apparatus utilizing a plurality of subject cards with corresponding decks of question and answer cards and including improved means for receiving, retaining and displaying the subject and question and answer cards.

10 Claims, 4 Drawing Figures

GAME APPARATUS

Game apparatus particularly those used in teaching situations should offer ease of playing, variety, chance, multiple dislay arrangements, suspense and esthetic appeal. Furthermore, in order to utilize the game apparatus for differing class or subject situations, the components of the game apparatus, such as subject and question and answer cards, should be readily interchangeable.

By means of the present invention which includes a four-sided gameboard and means are to captively retain a plurality of differing subject and corresponding question and answer cards adjacent the outer periphery thereof, the above specified objectives of a game apparatus are met in a superior manner. Furthermore, the selection of question and answer cards from their respective stacks are greatly facilitated by the inclusion in the gameboard of the present invention of downwardly sloping seating arrangements. Still further, the subject and question and answer cards of the present invention are presented in such a manner that the printed material on such cards are presented simultaneously to the north, south, east and west directions of the game board. In addition, the present invention includes display means which are selectively usable to present either the question or answer side of a specific question and answer card.

These and other objects and advantages of the present invention will become more readily apparent from a reading of the following description and drawings in which.

Figure 1:
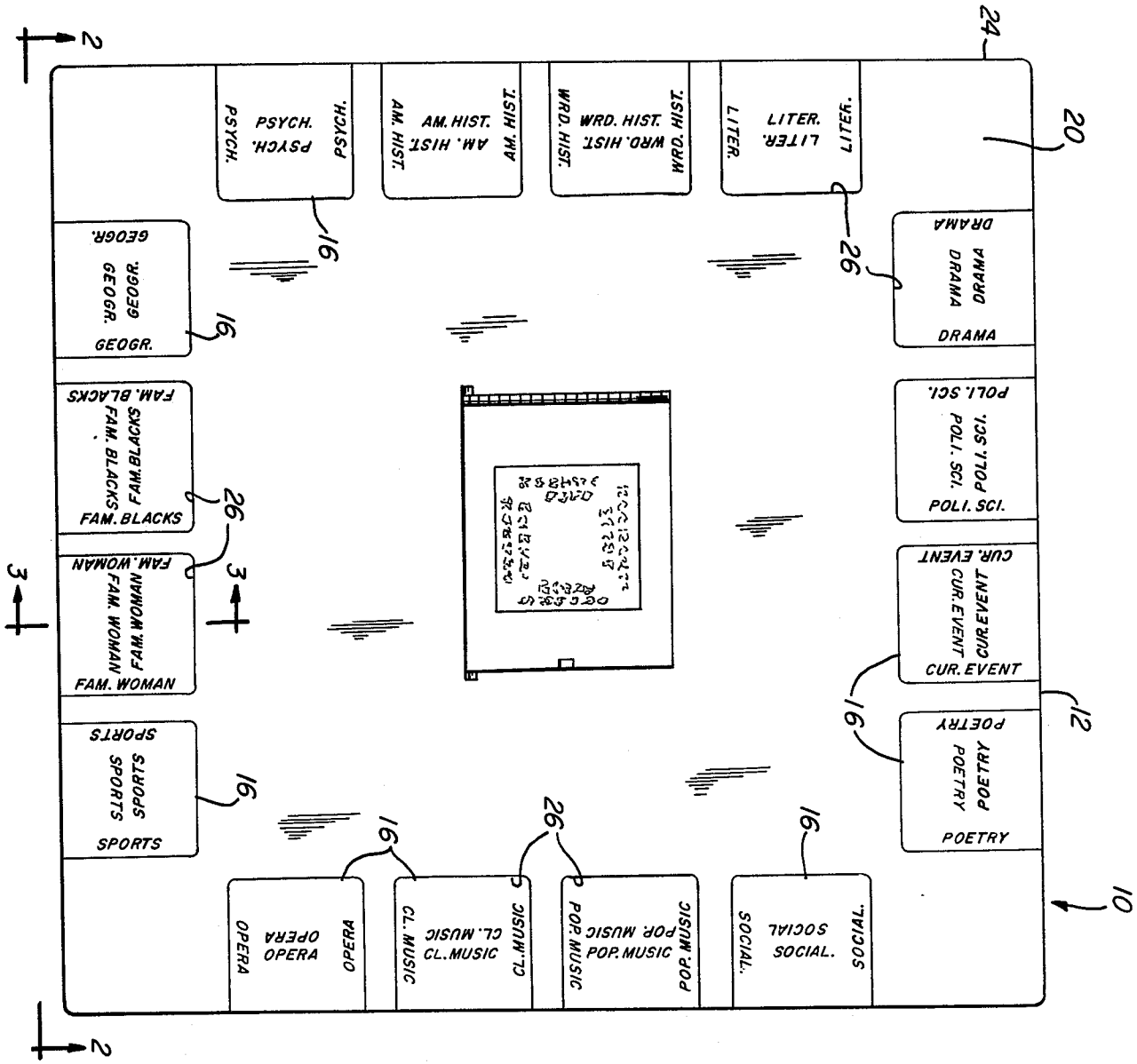
FIG. 1 is a plan view of a game board constructed in accordance with the principles of the present invention with subject playing cards captively positioned within the board.

A game apparatus, generally indicated at 10, is illustrated in FIGS. 1–4 and comprises: a game board 12; a playing card viewer 14 pivotally carried on a central position of board 12 adjacent the upper surface thereof; and a plurality of subject cards 16 and corresponding decks of playing cards 18 which are captively carried by board 12 in a manner as described hereinafter.

As shown, board 12 is of a generally hollow unitary configuration formed of any suitable material, for example a plastic type material, and comprises an upper wall 20; a lower wall 22 downwardly spaced from wall 20; and a peripheral wall 24 extending generally continuously and vertically between walls 20 and 22 adjacent the outer peripheries thereof.

A plurality of upwardly open, peripherally spaced subject card seating depressions 26 are formed about the periphery of the upper wall 20 of board 12. Any suitable number of depressions 26 may be formed within upper wall 20 and, as shown, four depressions 26 are formed along each side of wall 20 for a total of sixteen depressions 26 in the wall 20. The peripheral configuration of each depression 26 conforms to the peripheral configuration of the subject cards 16 to provide for the captive seating of an independent subject card 16 within each respective depression 26 when a game is being played.

To provide variety, chance and suspense it is anticipated that when playing a game utilizing the game apparatus 10 of the present invention, that a subject card 16 pertaining to a differing area of knowledge be seated in each depression 26. In the embodiment illustrated, the subject cards are representative of a game to be played by mature individuals and includes a plurality of distinct areas of knowledge including; geography, famous blacks, famous woman, sports, opera, classical music, popular music, sociology, poetry, current events, political science, drama, literature, world history, American history and psychology. Of course the game apparatus is equally adapted to usage with less mature individuals by simply substituting more basic subject and playing cards, for example; colors, animals, fairy tales, basic science, basic history, spelling and the like.

It is anticipated that the same apparatus will be played by a plurality of players positioned about the periphery of the game board 12. Accordingly, the written indicia on each of the subject and playing cards 16 and 18, respectively, is repeated four times with each independent indicia being normal with respect to the adjacent indicia on the cards. With such an arrangement the indicia is presented in a normal reading manner to all players regardless of which side of the game board they are sitting on. Hence, by not having to read subjects, questions or answers upside down or sideways the convenience and ease of playing of the game is greatly amplified over similar prior art arrangements. Furthermore, inasmuch as each player can readily and independently read the indicia the sense of participation is greatly amplified over these arrangements wherein one player reads both questions and answers. Without this sense of participation marginal players may become easily bored and further participation will be from a sense of duty, particularly when the game is being utilized for educational purposes.

A plurality of outwardly open peripherally spaced inwardly projecting playing card receiving pockets 28 are formed within peripheral wall 24 vertically intermediate walls 20 and 22. Each pocket 28 is downwardly spaced from and in vertical alignment with a respective depression 26 and comprises: an upper wall 30 downwardly spaced from wall 20; a lower wall 32 spaced from upper wall 30; an inner wall 34 extending transversely between walls 30 and 32 adjacent the inner ends thereof; and a pair of inwardly extending transversely spaced sidewalls 36. Pockets 28 are adapted to receive a deck consisting of a plurality of playing cards 18 therewithin. As the game is being played a player will remove the top playing card 18, from the decks of playing cards 18 within a pocket 28 and place the selected playing card 18 in the viewer 14 in a manner as described hereinafter. To aid in this selection of playing cards 18 walls 32 and 34 are sloped in a novel manner. Specifically, bottom wall 32 of opening 28 slopes inwardly and downwardly from peripheral wall 24 with the innermost end of bottom wall 32 being spaced downwardly and inwardly from the innermost end of upper wall 30. Inner wall 34 slopes downwardly and inwardly with the uppermost end thereof adjacent the innermost end of top wall 30 with the lowermost end of wall 34 being adjacent the innermost end of bottom walls 32.

With an arrangement of pocket 28 and sloping walls 32 and 34 as described hereinabove the selection of playing cards 18 is greatly facilitated. With such an arrangement, a deck of playing cards resting in a slant on wall 32 permits an easier selection of the top card without disturbing the lower cards, than if the deck of cards 18 were on a horizontal. Furthermore, the backward slope of wall 32 provides for an inward slope at the outer edge of the deck of cards 18 thereby permiting an even easier selection of the top card 18 from the deck.

Figure 2:
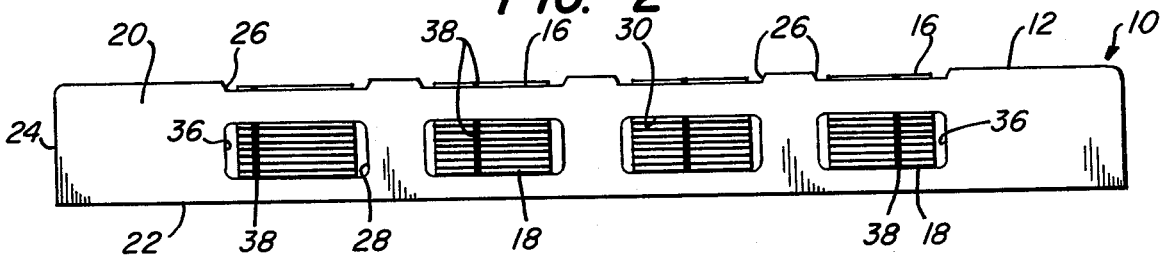
FIG. 2 is an end view of the game board viewed on line 2—2 of FIG. 1.
Figure 3:
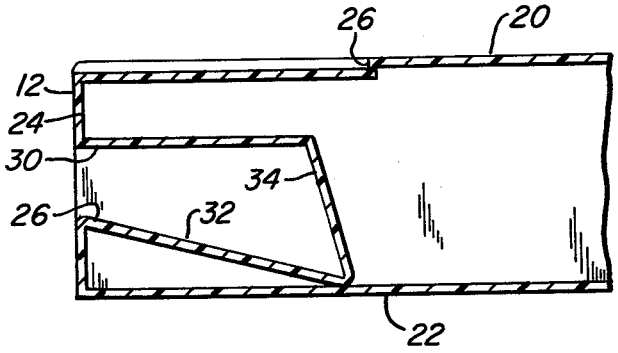
FIG. 3 is an enlarged partial cross-sectional view of a playing card pocket taken on line 3—3 of FIG. 1 with the subject and playing cards removed.
Figure 4:
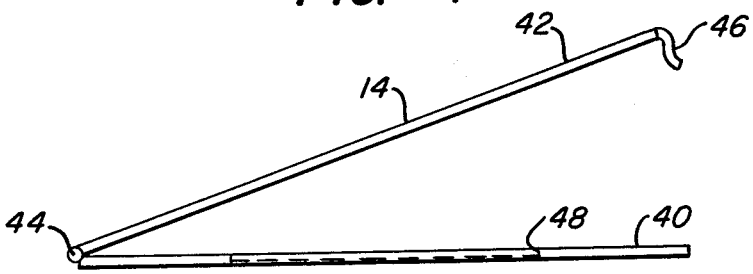
FIG. 4 is an enlarged side view of a playing card viewer constructed in accordance with the principles of the present invention.

Inasmuch as the invention herein contemplates the usage of a plurality of independent subject cards 16 and respective decks of playing cards 18, the embodiment as illustrated in FIG. 2 provides a bar identification system to provide efficient sorting and means to readily ascertain misplaced cards. Specifically, the inner and outer edges of each of the cards 16 and 18 have a marking thereon. The markings on each specific set of cards 16 and 18 form a vertical bar 38 which is at a different transverse orientation from any other specific set of cards 16 and 18. If desired the bars 38 can also be color coded.

Each playing card 18 includes a question on one side thereof and an answer to the question on the verso side thereof. As discussed hereinbefore the written indicia for each question and answer is repeated four times to face in four separate directions for purposes of convenience and ease of playability.

The decks of playing cards 18 are inserted within respective pockets with the question side up. The selected card 18 is then positioned within viewer 14, question side up. Viewer 14 comprises a stationary bottom member 40; a top member 42 pivotally connected to bottom member 40 adjacent one end thereof at a continuous hinge 44; and a suitable latching means, shown schematically as spring latching member 46.

Bottom member 40 includes an upwardly open centrally located card receiving depression 48 therewithin. When a playing card 18 is selected it is positioned within depression 48, question side up, and top member 42 is pivoted downwardly about hinge 44 and latched into closed position in mating relationship with bottom member 40 by spring latching member 46 engaging bottom member 40 at the end thereof opposite hinge 48. Both top and bottom members 40 and 42 are constructed of a transparent material in a suitable image enlarging finish to aid the viewer in reading the written indicia on playing card 18. When the players have had an opportunity to read the question on the playing card 18 and then answer in a written or oral manner, the viewer 14 is pivoted in a manner that the bottom member 40 faces upwardly thus exposing the answer side of the playing card 18. Any suitable means may be provided for pivoting viewer 14 for example, a pair of spaced pivot pins 50 which are carried by upper wall 20 of game board 12 and which pivotally communicate with bottom member 40. Pivot pins 50 define a pivot axis extending transversely therebetween in a direction generally normal to the pivot axis of hinge 44.

By the inclusion of a viewer 14 such as described hereinabove, additional features of convenience, esthetic appeal and sense of participation are provided with the game apparatus of the present invention. Specifically, the magnification and convenient location of the viewer 14 are of great appeal to a player. Furthermore, the very fact that the mechanical steps of inserting cards and flipping the viewer 14 are included provide a player with a tangible sense of participation. Furthermore, the viewer 14 creates a degree of suspense as to the up and coming answer to a specific playing card 18 which is much superior to the usual arrangement of merely flipping a card.

The invention herein resides in the improved configuration of the game apparatus 10. Accordingly, modifications may be made by one skilled in the art to the invention described hereinabove without departing from the scope of the invention, for example; rather than having a hollow double-walled game board 12, a single rigid top member of transparent material or colored and transparent material is contemplated. In such an instance a plurality of members containing playing card receiving pockets of a configuration as described hereinabove are secured to the underside of the single rigid top member. If desired, the top member can include a subject card receiving depression therewithin or a slot may be included adjacent the upper end of the members containing the playing card receiving pockets.

Other examples of modifications to the invention herein which are within the purview of one skilled in the art are: including means for folding game board 12 in half; differing supporting and pivoting arrangements for playing card viewer 14; providing a transparent member over seating depressions 26; providing an open flanged seating arrangement rather than forming depressions 26; altering the configuration of pockets 28; and the like.

What is claimed is:

1. A game apparatus comprising: a main body member; a plurality of seating means carried by said body member and adapted to seat subject cards thereon; said seating means extending inwardly with respect to the periphery of said body member and circumferentially spaced therearound; a plurality of card receiving pockets carried by said body member with each of said pockets adapted to loosely receive a plurality of playing cards therewithin at a location no higher than the uppermost surface of said body member; and said pockets extending inwardly with respect to the periphery of said body member, in vertical alignment with respect to respective ones of said seating means and downwardly spaced from said seating means.

2. A game apparatus as specified in claim 1 wherein said pockets include a lower playing card seating portion and said lower seating portion slopes inwardly and downwardly with respect to a generally horizontal uppermost surface of said body member.

3. A game apparatus as specified in claim 2 wherein said pockets include an upper generally horizontally extending portion and an inner playing card seating portion and said inner seating portion extends downwardly and inwardly and communicates between the innermost ends of said upper portion and said lower seating portion.

4. A game apparatus as specified in claim 3 wherein the innermost end of said lower seating portion is spaced inwardly from the innermost end of said upper portion.

5. A game apparatus as specified in claim 1 including: viewing means carried by said body member upwardly adjacent the uppermost surface thereof and said viewing means being adapted to releasably carry selective ones of such playing cards therewithin.

6. A game apparatus as specified in claim 5 with said viewing means being pivotally carried by said body member to selectively display either the top surface or the verso surface of said viewing means.

7. A game apparatus as specified in claim 5 wherein the upper and lowermost surfaces of said viewing means are of an indicia magnifying configuration.

8. A game apparatus as specified in claim 1 additionally including subject and playing cards having written indicia thereon and the indicia on each of such cards being repeated four times in a manner that each indicia on each of said cards faces in a direction normal to the adjacent indicia on the same card.

9. A game apparatus as specified in claim 1 wherein said main body member includes spaced upper and lower generally planar walls and a substantially continuous peripheral wall extending generally vertically between said upper and lower walls.

10. A game apparatus as specified in claim 9 wherein said seating means is formed within said upper wall and said pockets are formed within said peripheral wall.

* * * * *